US006536655B1

(12) United States Patent
Humphrey

(10) Patent No.: US 6,536,655 B1
(45) Date of Patent: Mar. 25, 2003

(54) PACKAGE FOR LAMP AND COLLAPSIBLE SHADE

(75) Inventor: Neall W. Humphrey, El Dorado Hills, CA (US)

(73) Assignee: Trade Source International, El Dorado Hills, CA (US)

( * ) Notice: Subject to any disclaimer, the term of this patent is extended or adjusted under 35 U.S.C. 154(b) by 0 days.

(21) Appl. No.: 10/086,591

(22) Filed: Mar. 1, 2002

(51) Int. Cl.[7] ..... B65D 5/10
(52) U.S. Cl. ..... 229/115; 206/320; 229/148
(58) Field of Search ..... 229/115, 148; 206/320

(56) References Cited

U.S. PATENT DOCUMENTS 443,397 A * 12/1890 Mack ..... 229/115
1,933,643 A * 11/1933 Tanner ..... 229/115
2,419,510 A * 4/1947 Van Rosen ..... 229/115
3,006,527 A * 10/1961 Lofquist, Jr. ..... 229/115
3,295,740 A * 1/1967 Hall ..... 229/148
3,493,104 A * 2/1970 Tempelhof ..... 229/115
4,425,731 A * 1/1984 Orlando ..... 229/115
5,375,713 A * 12/1994 Horvat et al. ..... 229/115
5,523,934 A * 6/1996 Dworman et al. ..... 206/320

FOREIGN PATENT DOCUMENTS

GB 2043595 A * 10/1980 ..... 229/115

* cited by examiner

*Primary Examiner*—Gary E. Elkins
(74) *Attorney, Agent, or Firm*—Oppenheimer Wolff & Donnelly LLP

(57) ABSTRACT

A package for holding a lamp and collapsible shade where a blank is folded into an open ended generally triangularly shaped box, the lamps and collapsible shade being disposed in the box and the open end of the box being closed off by a foldable panel.

4 Claims, 3 Drawing Sheets

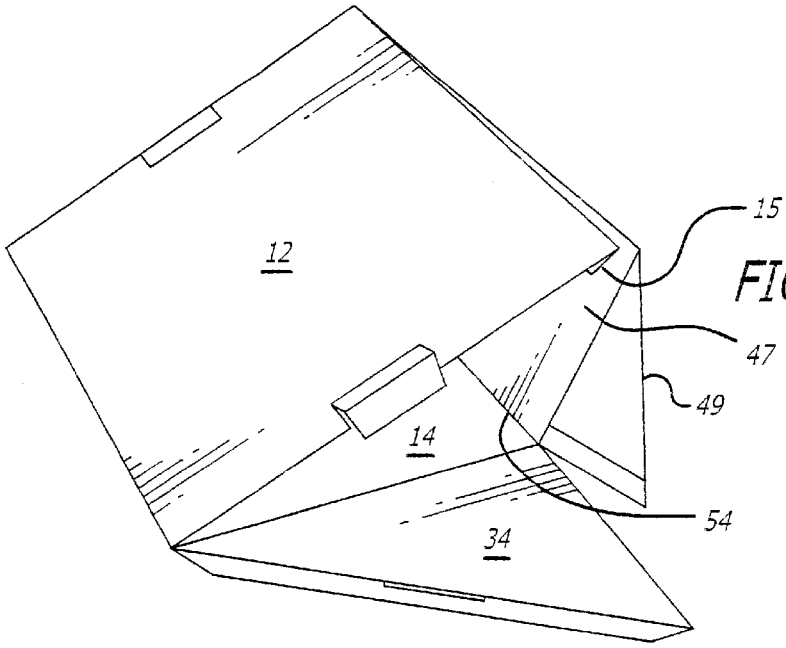
FIG. 3
FIG. 4
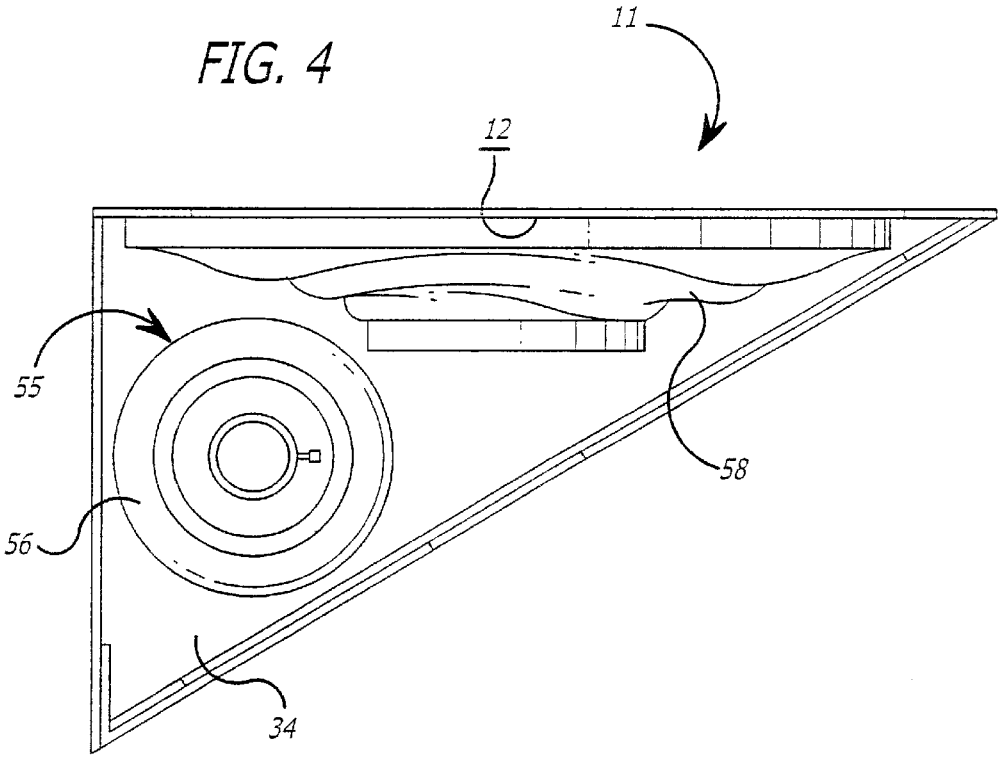

PACKAGE FOR LAMP AND COLLAPSIBLE SHADE

BACKGROUND OF THE INVENTION

1. Field of the Invention

The invention relates to packaging, and, more particularly, to a package for accommodating a lamp and collapsible shade for shipment.

2. General Background and State of the Art

Various packages are known for shipping lamps and shades. Generally, such packages must be relatively large and bulky to accommodate a lamp and its shade. Some shades are collapsible but heretofore there has been no package that could economically accommodate a lamp and its collapsible shade for shipment in a safe manner.

There is a need for a package for shipping a lamp and its shade in a safe manner that uses less packaging material than known packages.

INVENTION SUMMARY

It is an object of this invention to provide an improved package for shipping a lamp and its collapsible shade.

It is a further object of this invention to carry out the foregoing object using a lesser amount of packaging material than known similar packages.

These and other objects are preferably accomplished by a blank which can be folded into an open ended generally triangularly shaped box, a lamp and a collapsible shade being disposed in the box and the open end of the box being closed off by a foldable panel.

BRIEF DESCRIPTION OF THE DRAWINGS

FIG. 3 is a partially assembled view of the blank of FIG. 1 into a package;

FIG. 4 is a view of one of the packages of FIG. 1 open to show a lamp and collapsible shade mounted therein;

DETAILED DESCRIPTION OF THE PREFERRED EMBODIMENTS

Figure 1:
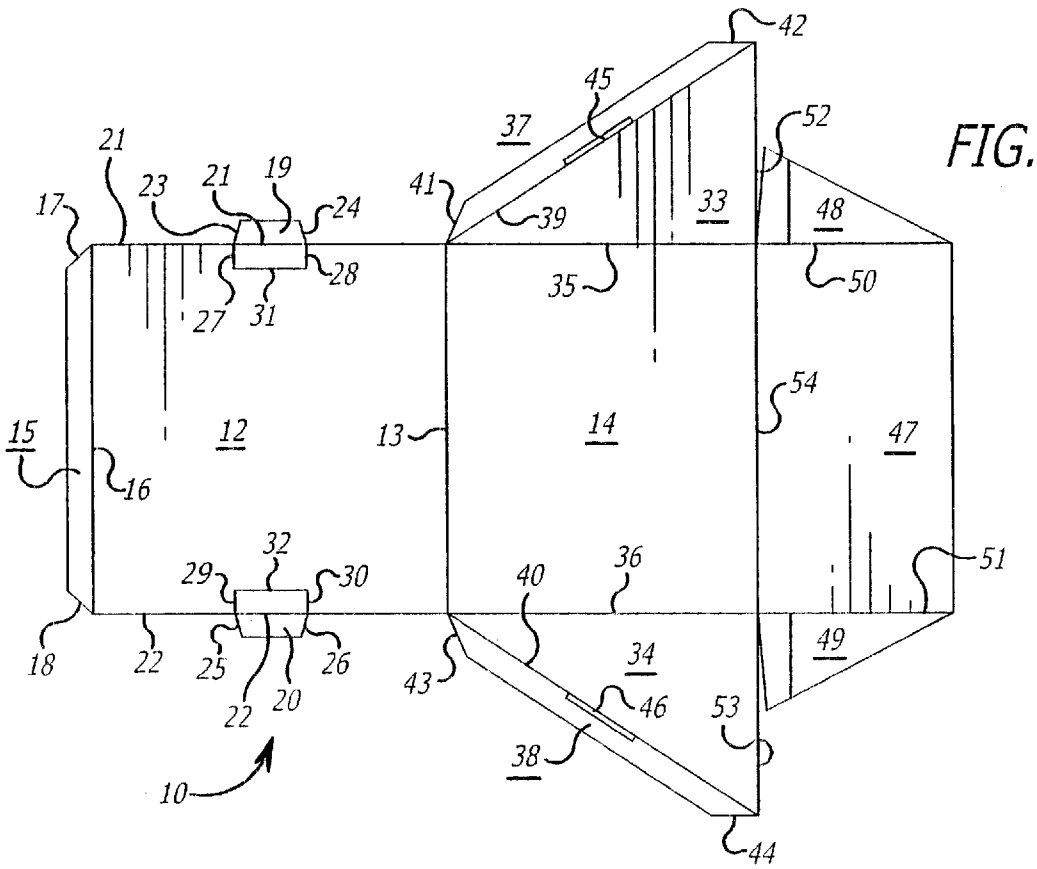
FIG. 1 is a plan view of a blank for forming the package of the invention.
Figure 2:
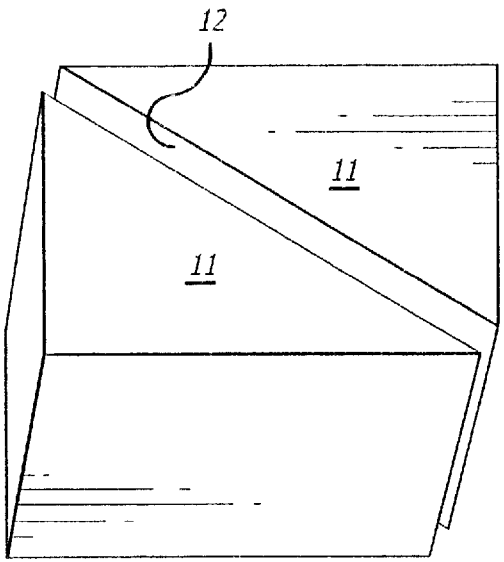
FIG. 2 is a view of the assembled blank of FIG. 1 forming a package, a second identical package being disposed by the side of the first package.

Referring now to FIG. 1 of the drawing, a blank 10 is shown for forming the box or package 11 shown in assembled position in FIG. 2 (two such boxes 11 disposed side by side are shown, which is how they might be displayed on a store shelf or the like).

As seen in FIG. 1, a first flat planar generally square shaped panel 12 is shown foldably connected at fold line 13 to a second flat generally rectangular planar panel 14. As will be discussed, panel 14 may be as long as panel 12 but slightly shorter.

A first flap 15 is foldably connected to panel 12 along fold line 16. Flap 15 may be generally trapezoidally shaped having tapered spaced sides 17, 18.

A pair of smaller flaps 19, 20 are disposed along side walls 21, 22, respectively, of panel 12 at generally the middle of each side wall 21, 22. Each flap 19, 20 is foldably connected to panel 12 along its respective fold lines 21, 22. Each flap 19, 20 is also generally trapezoidally shaped having tapered spaced side walls (side walls 23, 24 of flap 19 and side walls 25, 26 of flap 20).

A pair of spaced slits (27, 28 for flap 19 and 29, 30 for flap 20) extend inwardly in panel 12 about the width of each flap 19, 20. These slits extend to a fold line on panel 12 (that is, slits 27, 28 terminate at fold line 31 and slits 29, 30 terminate at fold line 32). Fold lines 31, 32 are parallel to its respective fold line 21, 22 and slits 27, 28 and 29, 30 extend normal thereto.

Panel 14 has a generally triangularly shaped panel 33, 34 on each side thereof connected thereto along respective fold lines 35, 36. Panels 33, 34 are as long as the shorter side walls of panel 14 and each has a flap (flaps 37, 38, respectively) connected to its respective panel 33, 34 along respective fold lines 39, 40. Each flap 37, 38 is also generally trapezoidally shaped having spaced tapered side walls 41, 42 and 43, 44, respectively. A generally rectangular cut-out slot (slot 45 along fold line 39 and slot 46 along fold line 40) is provided on each flap 37, 38.

A third generally planar rectangular panel 47 is provided connected to panel 14 along fold line 54. Panel 47 is as wide as panel 14 along fold line 54 but lesser in width.

A pair of flaps 48, 49 are foldably connected on opposite sides of panel 47 along respective fold lines 50, 51. A cut-out slit (slit 52 between flaps 33, 48 and slit 53 between flaps 34, 49) is provided on each side of panels 14, 47 for ease of assembly.

The assembly of panel 10 into the box 11 of FIG. 2 will be now described. Panel 12 is folded along fold line 13 and panel 47 is folded along fold line 34. Flap 15 is glued or otherwise secured to panel 47 (preferably on the side shown in FIG. 1).

This intermediate position is shown in FIG. 3, the panels 12, 47 being secured along fold line 54. Panel 49 is folded inwardly and panel 34 is folded at fold line 36 on top of panel 34 with flap 38 extending under panel 12 closing off one end of box 11. Tab 20 is now inserted into slot 46 thus securing panel 34 in place.

At the opposite open end, panel 48 is folded inwardly and panel 33 is folded on top of panel 48 with its flap 37 abutting against panel 12 on the side thereof shown in FIG. 1. Flap 19 is now folded about its fold line 21 and inserted into slot 45 thus closing off the open end of box 11.

As seen in FIG. 2, the side panels 12 can be disposed adjacent each other forming a generally rectangularly shaped shipping package where two such boxes 11 may be shipped together.

Any suitable dimensions may be used. For example, panel 12 may be about 19¼"×19¼", panel 47 may be about 10½"×19¼" inches and panel 14 may be about 19¼"×16½". The other panels and flaps may be similarly dimensioned.

Any suitable materials may be used. Cardboard is preferred for its economical cost and foldability.

The packaging of a lamp and its collapsible shade are shown in FIG. 4. Box 11 is shown looking down inside toward one of the side wall panels, such as panel 34. A conventional lamp 55 is shown having its base 56 resting on the bottom panel 34. A collapsible shade 58 is collapsed and disposed between lamp 55 and side wall panel 12. The other end or panel 33 is now folded and closed as heretofore discussed. If desired, packaging material, such as bubble wrap or the like, may be disposed inside of box 11 between lamp 55 and shade 58. Also, the lamp 55 and shade 58 may be wrapped in protective material. Although the shade 58 is shown in FIG. 4 as disposed along the "hypotenuse" side of box 11 (panel 12), it may also be disposed along the base side (panel 14).

Although the triangularly shaped sides 33, 34, 48, 49 are shown as connected to their respective panels in a particular orientation, obviously the hypotenuse of each side may extend in a mirror image thereof. Also, although a blank is disclosed, the panels may be separate parts secured in any suitable manner to form the triangularly shaped open ended box shown in FIG. 3. The open end can then be closed off in any suitable manner after the lamp and shade are mounted therein.

Figure 5:
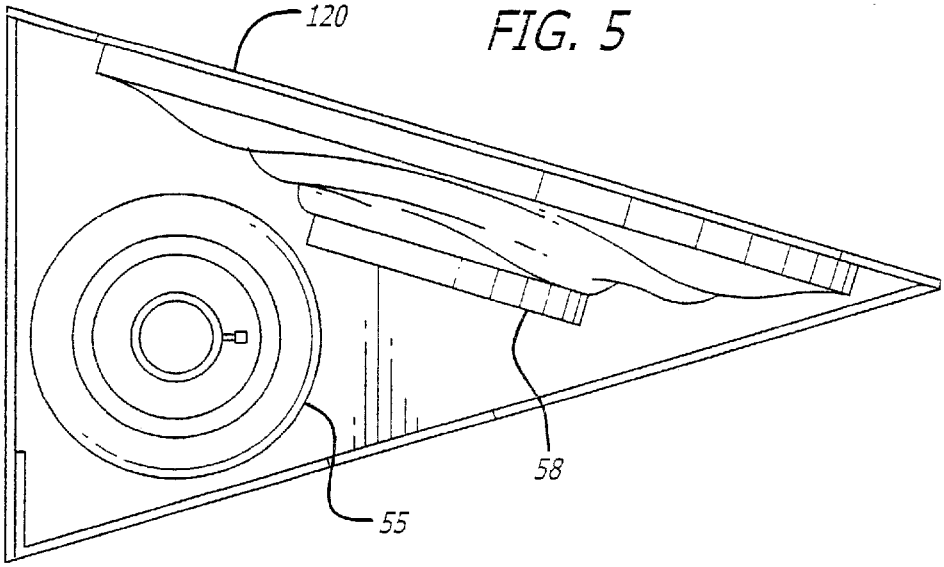
FIG. 5 is a view similar to FIG. 4 showing another type of package in accordance with the invention.

As seen in FIG. 5, lamp 55 and shade 58 are shown disposed inside of a box 100 wherein the panel 120, otherwise identical to panel 12, extends at an angle from the base thereof.

Figure 6:
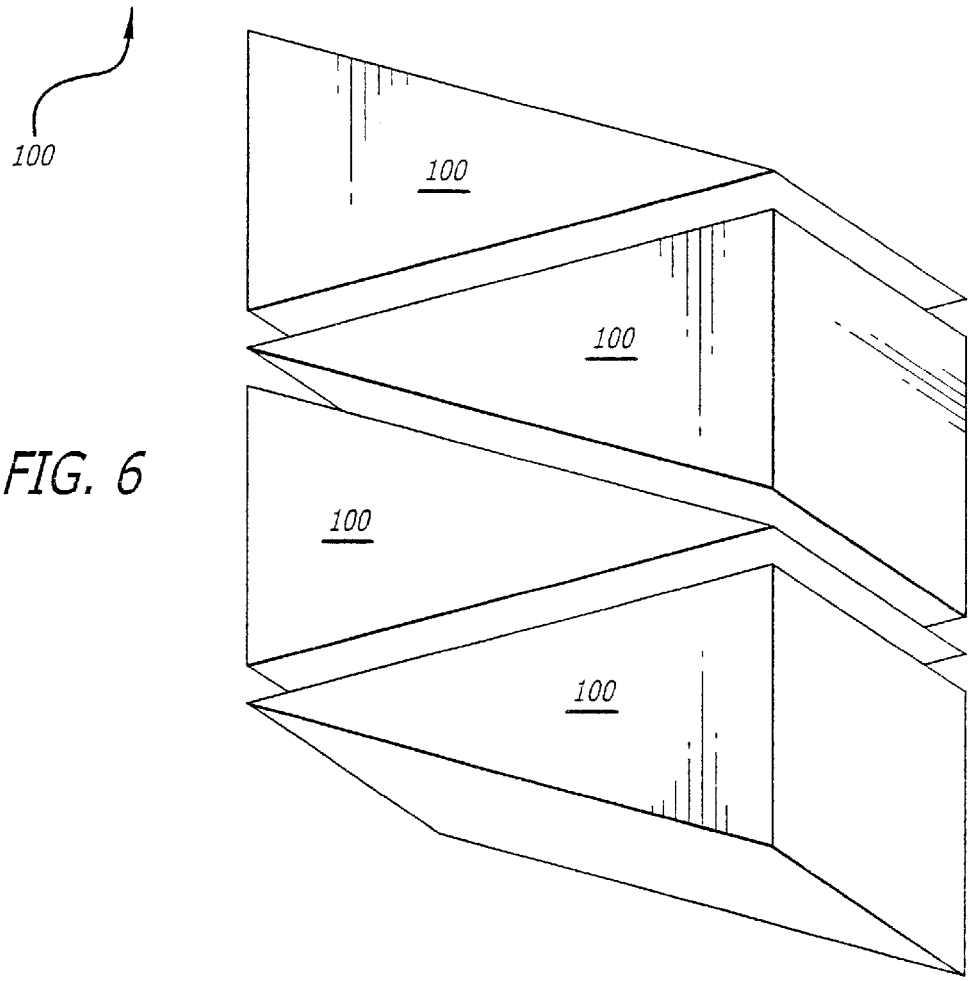
FIG. 6 is a view similar to FIG. 2 showing four of the packages of FIG. 5 mounted side by side.

As seen in FIG. 6, four boxes 100 similar to those in FIG. 5 are disposed side by side, the angled sides adjacent each other as shown.

Although a particular embodiment of the invention is disclosed, variations thereof may occur to an artisan and the scope of the invention should only be limited to the scope of the appended claims.

While the specification describes particular embodiments of the present invention, those of ordinary skill can devise variations of the present invention without departing from the inventive concept.

I claim:

1. A blank for forming a package to hold a lamp and a collapsible shade comprising:

a first generally planar panel (12) connected by a fold line (16) to a second generally planar panel (14);

a third generally planar panel (47) connected to the second generally planar panel (14) the width of said panels being substantially the same and the first panel (12) being slightly longer than the second panel (14) and the third panel (47) being substantially shorter than the second panel (14);

a flap (15) connected to said first panel (12) along a fold line (16) remote from the fold line (13) where said first panel is connected to said second panel (14);

a pair of side flaps (19, 20) foldably connected to spaced sides of said first panel (12);

a pair of generally triangularly shaped panels (33, 34) connected by fold lines (35), (36) to spaced sides of said second panel (14), one of said triangularly shaped panels being connected to the same side as where one of said side flaps is connected to said first panel (12), and the other of said triangularly shaped panels being connected to the same side as where the other of said flaps is connected to said first panel, each of said triangularly shaped panels (33, 34) having flaps (37, 38) connected thereto by fold lines (39, 40) spaced from the fold lines (35, 36) connecting said triangularly shaped panels to said second panel; and a pair of triangularly shaped panels (48, 49) connected by fold lines (50, 51) on opposite sides of said third panel (47), one of said last mentioned triangularly shaped panels being connected to the same side as where one of said first mentioned triangularly shaped panels is connected to said second panel (14), and the other of said last mentioned triangularly shaped panels being connected to the same side as where the other of said first mentioned triangularly shaped panels is connected to said second panel.

2. The blank of claim 1 wherein a pair of slits extend through said first panel from opposite sides of each of said pair of side flaps connected to spaced sides of said first panel at the point where each of said pair of side flaps are connected to said first panel inwardly to a fold line spaced from the fold line connecting each of said flaps to said first panel.

3. The blank of claim 1 including a pair of slots formed along the fold lines where each of the flaps are connected to the triangularly shaped panels connected to said second panel.

4. The blank of claim 1 wherein each of said triangularly shaped panels has a long side, a short side and a hypotenuse connected to one end of said short side, said short sides of respective ones of said triangularly shaped panels connected to said third panel being disposed against the short sides of respective ones of said triangularly shaped panels connected to said second panel.

* * * * *